US005836281A

United States Patent [19]

Godeau et al.

[11] Patent Number: 5,836,281

[45] Date of Patent: Nov. 17, 1998

[54] APPARATUS FOR OPTIMIZING THE INTERCONNECTION PATHS OF ELONGATE CONDUITS

[75] Inventors: Denis Godeau, Joudry; Anthony Garcia, Villemandeur, both of France

[73] Assignee: Hutchinson, Paris, France

[21] Appl. No.: 699,226

[22] Filed: Aug. 19, 1996

[30] Foreign Application Priority Data

Sep. 15, 1995 [FR] France ..... 95 10829

[51] Int. Cl.[6] ..... F02F 7/00

[52] U.S. Cl. ..... 123/195 A; 123/41.54; 123/41.55

[58] Field of Search ..... 211/182; 248/671; 180/68.4, 229, 291, 299; 123/41.01, 41.54, 41.55, 195 A

[56] References Cited

U.S. PATENT DOCUMENTS 4,640,341 2/1987 Ozawa ..... 180/229

FOREIGN PATENT DOCUMENTS 874337 8/1942 France .
356312 8/1961 Switzerland .
2249347 5/1992 United Kingdom .

*Primary Examiner*—Noah P. Kamen
*Attorney, Agent, or Firm*—Bell Seltzer Intellectual Property Law Group of Alston & Bird LLP

[57] ABSTRACT

The present invention relates mainly to interconnection apparatus in particular for hydraulic and pneumatic purposes, for interconnecting the various members of a motor vehicle internal combustion engine. A rigid cradle of the invention includes means for fixing to the engine unit and means for fixing to elongate interconnection bodies, in particular rigid tubular ducts, hoses, electric cables, optical fibers, and/or bundles of cables. The present invention is mainly applicable to the automotive industry.

11 Claims, 4 Drawing Sheets

APPARATUS FOR OPTIMIZING THE INTERCONNECTION PATHS OF ELONGATE CONDUITS

The present invention relates mainly to interconnection apparatus, in particular for hydraulic and pneumatic interconnections between the various members of a motor vehicle internal combustion engine.

BACKGROUND OF THE INVENTION

Proper operation of a motor vehicle engine cannot be achieved without interconnecting various pneumatic, hydraulic, and electrical circuits connecting various members of the engine to one another and to external devices. When the vehicle is assembled, or during maintenance thereof, it is therefore essential to be able to pass and connect numerous elongate bodies, in particular flexible hoses, rigid pipes, cables, or bundles of cables in the engine compartment.

That gives rise to numerous problems for motor vehicle manufacturers.

The paths followed by the various elongate bodies need to take account not only of the space available in the engine compartment, but also of proximity to hot elements such as parts of the engine or certain tubular ducts that risk compromising proper operation of elongate bodies that are fragile or that contain cold liquids. Similarly, it may be necessary to hold cables away from sources of electrical and/or magnetic disturbance. This problem is particularly important for flexible elongate bodies whose position can vary when they are subjected to vibration. Motor vehicle manufacturers have therefore been obliged to design elongate body paths that provide good safety at the expense of not making optimum use of the space available inside the engine compartment.

It is also necessary at all costs to avoid connection errors which means that connectors must have keying means to prevent wrong connection and/or that robotized assembly lines should be used. It should be observed that robotized assembly does not prevent future connection errors occurring during maintenance, e.g. when replacing a hose. Also, the disposition of elongate bodies in the engine compartment of a motor vehicle spoils the appearance of the engine unit.

OBJECTS AND SUMMARY OF THE INVENTION

Consequently, an object of the present invention is to provide reliable interconnection apparatus for the various members of a motor vehicle engine.

Another object of the present invention is to provide apparatus that enables optimized interconnections to be achieved by implementing elongate bodies that are short.

Another object of the present invention is to minimize interconnections made during vehicle assembly.

Another object of the present invention is to provide interconnection apparatus of pleasing appearance that matches that of the engine unit.

Another object of the present invention is to provide an engine unit fitted prior to installation in the engine compartment with apparatus that provides at least some of the connections required for proper operation thereof.

The invention achieves these objects by a rigid interconnection cradle including means for fixing the cradle to the engine unit such as a fixing plate, and means for fixing elongate conduits to the cradle, in particular rigid pipes, flexible hoses, electric cables, optical fibers, and/or bundles of cables.

Advantageously, the cradle includes means for fixing to measurement members, regulation members, and/or members for controlling fluid flows.

The invention mainly provides an interconnection cradle for a motor vehicle heat engine, the cradle comprising a plurality of means for fixing to the engine and means for fixing to a plurality of conduits, in particular hoses, so that they follow optimized interconnection paths for the various members of the engine and/or of the vehicle.

The invention also provides a cradle, wherein the fixing means comprise elongate section members leaving a space into which a pipe, in particular a hose pipe, can be inserted by force, said members being disposed parallel to said pipes so as to releasably hold the pipes to the cradle by snap-fastening.

The invention also provides a cradle, including means for holding electrical or optical cables or any other fluid transfer duct.

The invention also provides a cradle, including an incorporated expansion chamber.

The invention also provides a cradle, including an incorporated header tank.

The invention also provides a cradle, including means for connecting pipes to the engine.

The invention also provides a cradle, including pipes, in particular hoses, held by the fixing means.

The invention also provides a cradle, wherein the ends of the pipes, in particular of the hoses, are provided with quick couplings or with collars.

The invention also provides an engine unit, including a cradle of the invention.

The invention also provides an engine unit, including:

a radiator connected to the engine by hoses;

a heat exchanger connected via hoses;

hoses for connection to the vehicle cabin heater; and a hose connected to the admission manifold; and wherein the hoses are fixed to the cradle by snap-fastening.

BRIEF DESCRIPTION OF THE DRAWINGS

The invention will be better understood from the following description and the accompanying figures given as a non-limiting example, and in which:

In FIGS. 1*a* to 2*b* the same references are used to designate the same elements.

MORE DETAILED DESCRIPTION

Figure 1A:
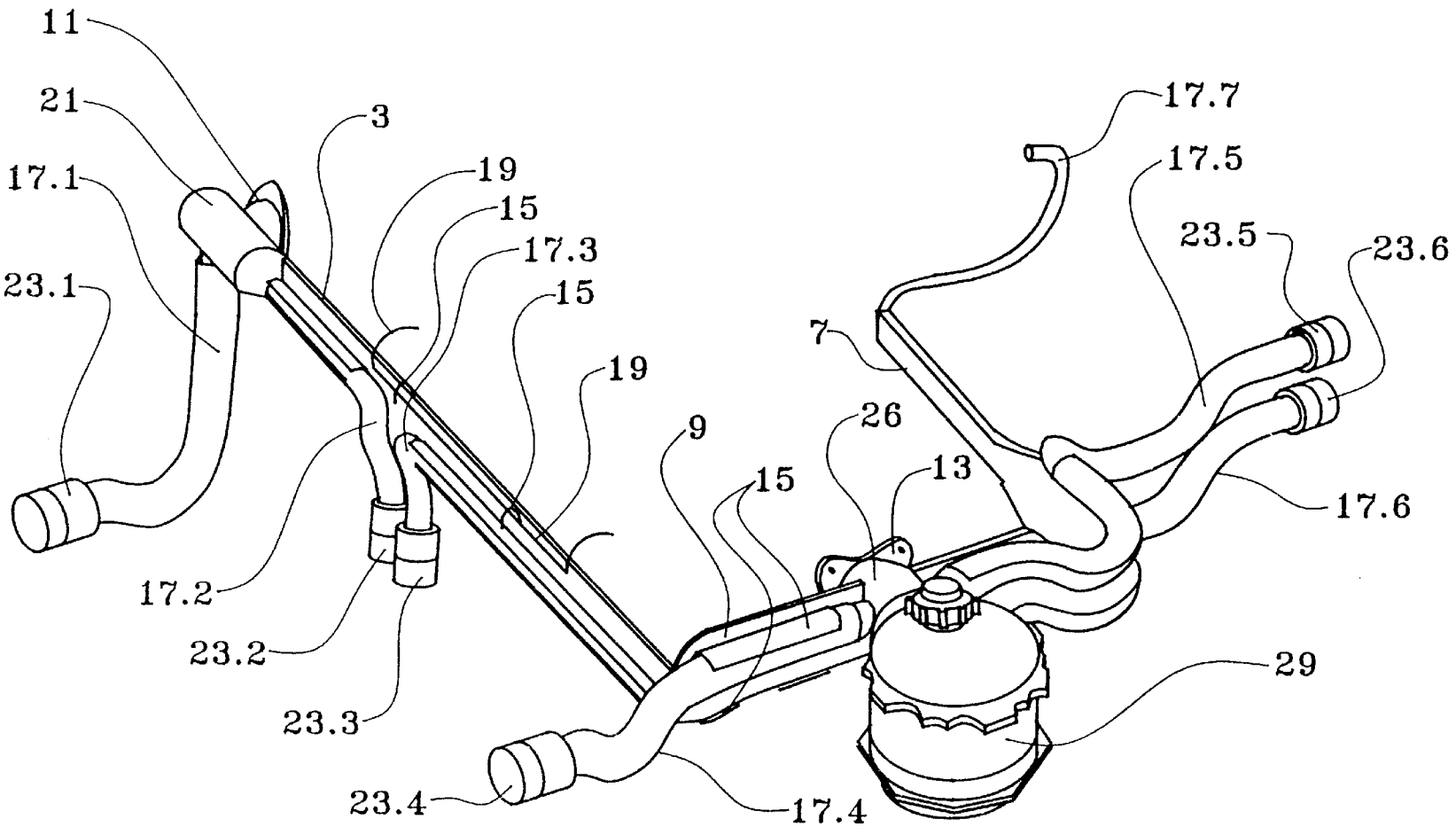
FIG. 1*a* is a front three-quarter perspective view from above of the preferred embodiment of the apparatus of the present invention.

In the figures, there can be seen the preferred embodiment of a cradle 1 of the invention comprising on elongate support member having a first branch 3 of length substantially equal to the width of an engine 5 (FIGS. 1*b* and 2*b*), a second branch 7 parallel to the first branch 3 and of length substantially equal to half the width of the engine 5, and interconnected by a third branch 9 which is orthogonal to the branches 3 and 7. The branches 3 and 9 carry respective fixing plates 11 and 13 for fixing the cradle 1 to the engine block 5.

The cradle 1 of the present invention is advantageously made of a plastics material, e.g. by extrusion blow-molding or by thermoforming. It may be provided with means for absorbing vibrations, electro-magnetic screening disposed close to sources of electro-magnetic disturbance, in particular around signal transmission cables, and thermal insulation means disposed close to sources of heat, around pipes or signal transmission cables.

The cradle 1 includes releasable conduit connectors 15 for fixing elongate conduits such as electric cables 19 or preferably-flexible tubular ducts 17, for example.

The configuration of the cradle of the present invention is a function of the engine block 5 to be fitted and in particular of the layout of the various members of the engine and its various fluid inlets and outlets.

The releasable conduit connectors 15 for fixing tubular ducts 17 comprise, for example, two elongate section members each defining a fraction of a cylindrical channel for receiving tubular ducts. A gap between the section members enables the elongate conduit to be forced through while it is being put into place and subsequently to be releasably held by snap-fastening. Naturally, other fixing methods could be used, e.g. using fixing plates, collars, adhesive, etc. without going beyond the ambit of the present invention.

Figure 1B:
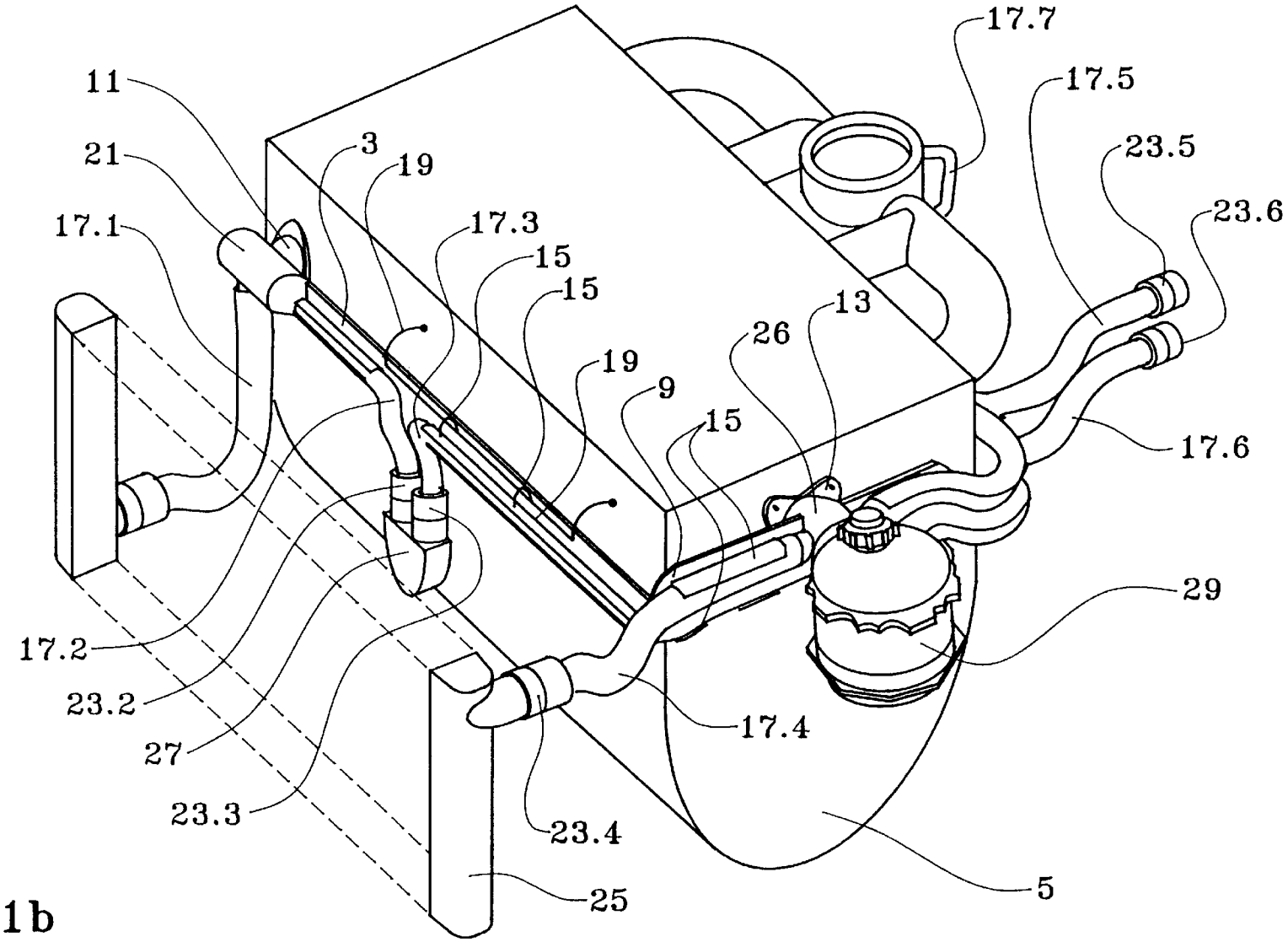
FIG. 1*b* is an analogous view of an engine block fitted with the FIG. 1*a* apparatus.
Figure 2A:
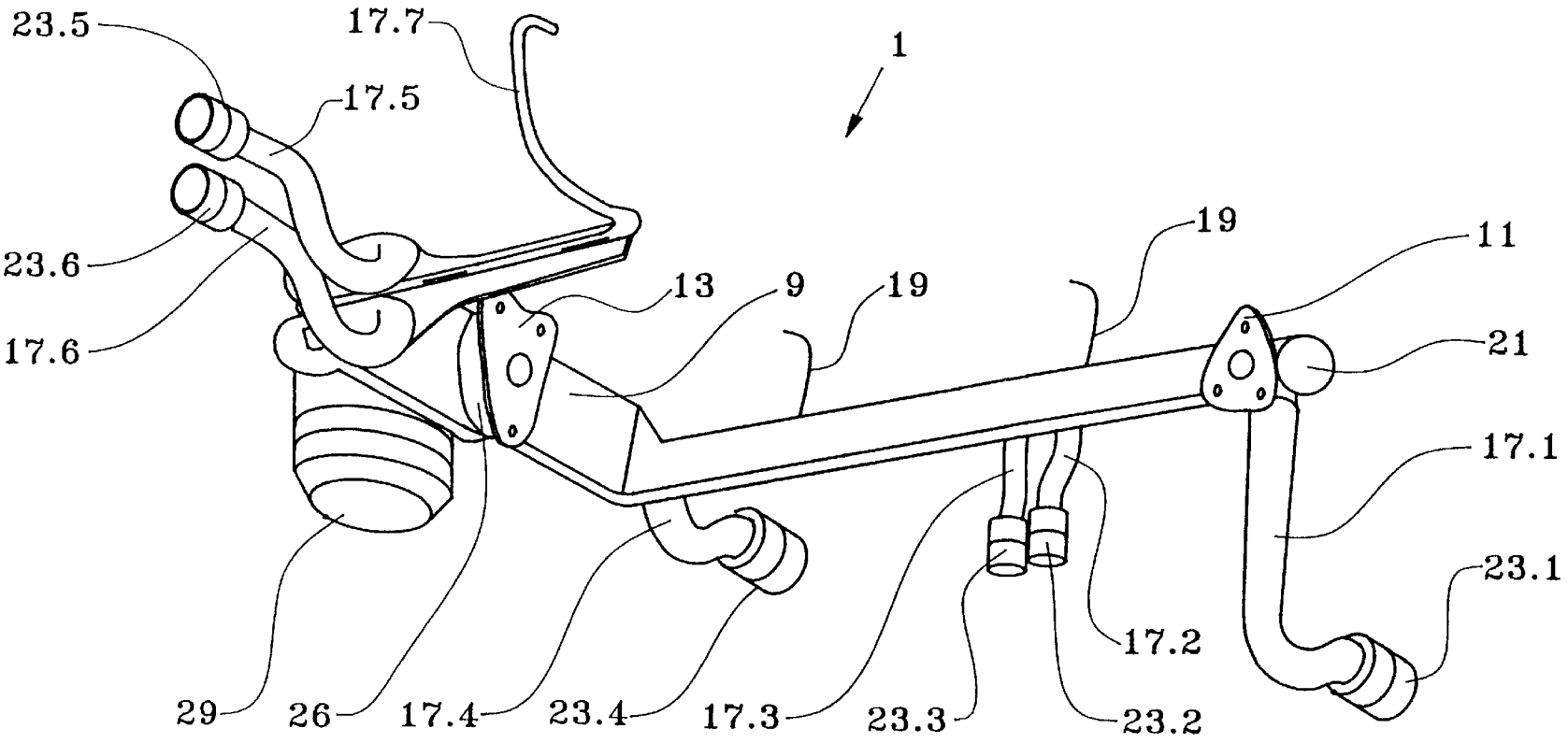
FIG. 2*a* is a back three-quarter perspective view from below of the FIG. 1*a* apparatus.
Figure 2B:
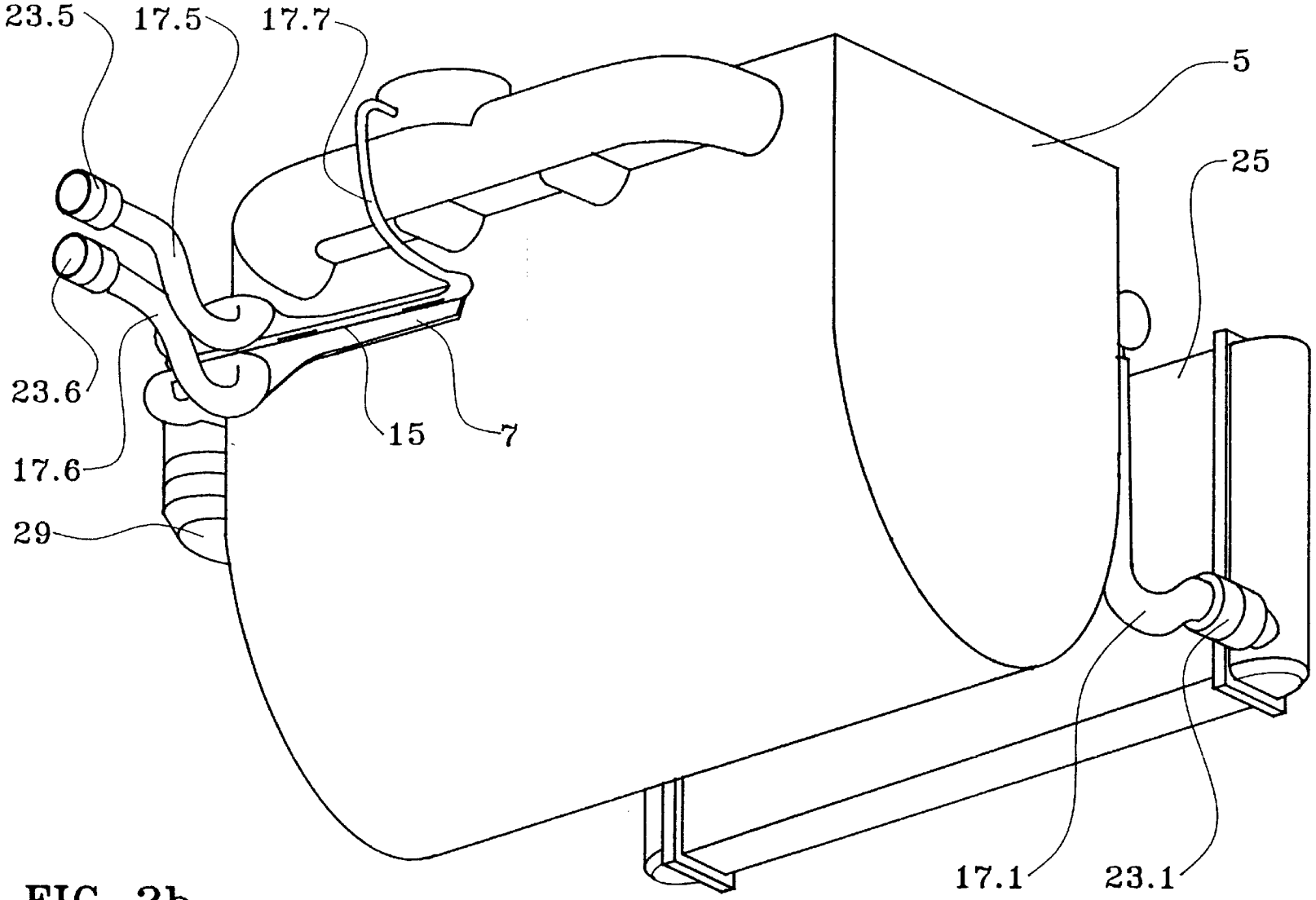
FIG. 2*b* is a view analogous to FIG. 2*a*, showing an engine block fitted with the apparatus of the invention.

In the example shown in FIGS. 1*b* and 2*b*, the outlet from the pump of the engine 5 is connected through the fixing plate 11 to a water inlet tank 21 carrying the elongate support member of the cradle of the present invention. The water inlet tank 21 is connected firstly via a hose 17.1 provided with a quick coupling 23.1 at its end to a radiator 25, and secondly via a hose 17.2 whose end is fitted with a quick coupling 23.2 to the inlet of a heat exchanger 27 for cooling engine oil.

Advantageously, the cradle 1 of the present invention includes an integral expansion chamber 29 carrying the elongate support member. An outlet from the water/oil heat exchanger is connected via a hose 17.3 whose end is fitted with a quick coupling 23.3 to a first inlet of the expansion chamber 29. A hose 17.4 having one end fitted with a quick coupling 23.4 connects the radiator 25 to an inlet of a water outlet tank 26 carrying the elongate support member. The engine block 5 is fed with water that has been cooled in the radiator 25 via a pipe passing through the fixing plate 11.

A hose 17.5 terminated by a quick coupling 23.5 feeds the vehicle cabin heater with hot water, water return taking place via a hose 17.6 terminated by a quick coupling 23.6. A hose 17.7 connects the degassing volume included in the expansion chamber 29 to the admission manifold of the vehicle.

It should be observed that the hoses 17.1 to 17.7 extend from the cradle 1 of the present invention for the purpose of being connected to the various members of the vehicle and/or of the engine.

Naturally, the present invention is not limited to use with tubular ducts, and it can equally well be applied to ducts of different section, e.g. ducts that are square or rectangular in section.

The cradle of the present invention can be used to pass the cables that are necessary for operation of the engine, e.g. cables connecting the ignition system to the engine spark plugs, and cables connecting the electrical power supply to the ignition system and to the starter. The cradle of the present invention can also be used to pass electrical or optical cables for interconnecting the engine with other members of the vehicle, e.g. cables connecting the various sensors for detecting proper operation of the engine to the vehicle dashboard.

The present invention is mainly applicable to the automotive industry.

We claim:

1. An interconnection cradle for a motor vehicle engine, comprising:

an elongate support member adapted to be attached to the motor vehicle engine, at least one fixing plate carrying said support member for affixing the interconnection cradle to the engine, and a plurality of releasable conduit connectors carrying said support member for affixing elongate conduits to the interconnection cradle so that the conduits follow optimized interconnection paths to components of the motor vehicle engine.

2. The interconnection cradle of claim 1, wherein said releasable conduit connector comprises a pair of elongate section members affixed to said support member and spaced apart from one another and defining a channel for receiving and releasably affixing the elongate conduit.

3. The interconnection cradle of claim 1, additionally including an elongate conduit releasably affixed to the interconnection cradle by at least one of said conduit connectors.

4. The interconnection cradle of claim 3, wherein said elongate conduit comprises a hose, and including a quick coupling carried by a distal end of said hose for connection to the motor vehicle engine.

5. The interconnection cradle of claim 1, further comprising an expansion chamber carried by said elongate support member.

6. The interconnection cradle of claim 1, further comprising a water inlet tank carried by said elongate support member.

7. The interconnection cradle of claim 6, further comprising a water outlet tank carried by said elongate support member.

8. An interconnection cradle for a motor vehicle engine, comprising:

an elongate support member adapted to be attached to the motor vehicle engine, said elongate support member comprising a first branch of length substantially equal to the width of an engine, a second branch parallel to said first branch, and a third branch orthogonal to said first and second branches and having two ends, said first branch attached to one end and said second branch attached to the other end, a first fixing plate carrying said first branch for affixing the interconnection cradle to the engine, a second fixing plate carrying said third branch for affixing the interconnection cradle to the engine, a plurality of releasable conduit connectors carried by said first branch for affixing elongate conduits to the interconnection cradle, a plurality of releasable conduit connectors carried by said second branch for affixing elongate conduits to the interconnection cradle, and a plurality of releasable conduit connectors carried by said third branch for affixing elongate conduits to the interconnection cradle.

9. An engine, comprising:

an engine block, an elongate support member adapted to be attached to the engine block, at least one fixing plate carrying said support member for affixing the interconnection cradle to the engine block, a plurality of releasable conduit connectors carried by said support member for affixing elongate conduits to the interconnection cradle so that the conduits follow optimized interconnection paths to components of the motor vehicle engine.

10. The engine according to claim 9, wherein said elongate support member comprises a first branch of length substantially equal to the width of an engine, a second branch parallel to said first branch, and a third branch orthogonal to said first and second branches and having two ends, said first branch attached to one end and said second branch attached to the other end.

11. The engine according to claim 9, further comprising:

an expansion chamber carried by said elongate support member, a water inlet tank carried by said elongate support member, a water outlet tank carried by said elongate support member, a radiator connected to said water outlet tank by an elongate conduit, said conduit being releasably affixed to the interconnection cradle by said releasable conduit connector, a heat exchanger for cooling engine oil having an inlet and an outlet, said inlet connected to said water inlet tank by a first elongate conduit and said outlet connected to said expansion chamber by a second elongate conduit, wherein said first elongate conduit and said second elongate conduit are releasably affixed to the interconnection cradle by said releasable conduit connector, a vehicle cabin heater connected to said engine block by at least one elongate conduit, said elongate conduit being releasably affixed to the interconnection cradle by said releasable conduit connector, and an admission manifold connected to said expansion chamber by at least one elongate conduit, said elongate conduit being releasably affixed to the interconnection cradle by said releasable conduit connector.

* * * * *